US009690235B2

(12) United States Patent
Noguchi

(10) Patent No.: US 9,690,235 B2
(45) **Date of Patent: *Jun. 27, 2017**

(54) INTERMEDIATE TRANSFER MEMBER AND IMAGE RECORDING METHOD

(71) Applicant: CANON KABUSHIKI KAISHA, Tokyo (JP)

(72) Inventor: Mitsutoshi Noguchi, Kawaguchi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/143,936

(22) Filed: May 2, 2016

(65) Prior Publication Data

US 2016/0246216 A1 Aug. 25, 2016

Related U.S. Application Data

(62) Division of application No. 14/289,913, filed on May 29, 2014, now Pat. No. 9,354,557.

(30) Foreign Application Priority Data

Jun. 12, 2013 (JP) ..... 2013-123616

(51) Int. Cl.

| | |
|---|---|
| ***B41J 2/01*** | (2006.01) |
| ***B41J 2/005*** | (2006.01) |
| ***G03G 15/16*** | (2006.01) |
| ***G03G 13/14*** | (2006.01) |

(52) U.S. Cl.

CPC ..... *G03G 15/1605* (2013.01); *B41J 2/0057* (2013.01); *B41J 2/01* (2013.01); *G03G 13/14* (2013.01); *B41J 2002/012* (2013.01)

(58) Field of Classification Search

CPC ..... B41J 2/01; B41J 2/0057; B41J 2002/012

See application file for complete search history.

(56) References Cited

U.S. PATENT DOCUMENTS

| | | | |
|---|---|---|---|
| 4,560,599 | A | 12/1985 | Regen |
| 5,389,958 | A | 2/1995 | Bui et al. |
| 5,754,209 | A | 5/1998 | Thomas et al. |
| 6,422,696 | B1 | 7/2002 | Takahashi et al. |
| 6,427,345 | B1 | 8/2002 | Alvis |
| 6,682,189 | B2 | 1/2004 | May et al. |
| 6,767,092 | B2 | 7/2004 | May et al. |
| 6,899,419 | B2 | 5/2005 | Pan |

(Continued)

OTHER PUBLICATIONS

U.S. Appl. No. 15/173,978, filed Jun. 6, 2016, Saito et al.
Second Office Action in Chinese Application No. 201410259194.7 (issued Sep 30, 2016).

*Primary Examiner* — Geoffrey Mruk
(74) *Attorney, Agent, or Firm* — Fitzpatrick, Cella, Harper & Scinto

(57) ABSTRACT

The invention provides an intermediate transfer member for use in an image recording method including the steps of applying a reaction liquid to the intermediate transfer member, applying an ink to the intermediate transfer member so as to overlap with at least a part of a region to which the reaction liquid has been applied, thereby forming an intermediate image, and transferring the intermediate image to a recording medium, wherein an average of a surface area per unit area of a surface of the intermediate transfer member is 1.2 or more and 10.0 or less.

13 Claims, 1 Drawing Sheet

(56) References Cited

U.S. PATENT DOCUMENTS

| | | | | |
|---|---|---|---|---|
| 6,902,266 | B2 | 6/2005 | Kaga et al. | |
| 7,780,286 | B2 | 8/2010 | Yahiro | |
| 7,789,503 | B2 | 9/2010 | Kusunoki | |
| 9,354,557 | B2 * | 5/2016 | Noguchi | G03G 13/14 |
| 2003/0234849 | A1 | 12/2003 | Pan et al. | |
| 2005/0110856 | A1 | 5/2005 | Mouri et al. | |
| 2006/0028526 | A1 | 2/2006 | Nakashima | |
| 2007/0279473 | A1 | 12/2007 | Tombs et al. | |
| 2012/0013691 | A1 | 1/2012 | Harris et al. | |

* cited by examiner

INTERMEDIATE TRANSFER MEMBER AND IMAGE RECORDING METHOD

CROSS-REFERENCE TO RELATED APPLICATIONS

This application is a divisional application of U.S. patent application Ser. No. 14/289,913, filed May 29, 2014, which claims the benefit of Japanese Patent Application No. 2013-123616, filed Jun. 12, 2013. Both prior applications are hereby incorporated by reference herein in their entirety.

BACKGROUND OF THE INVENTION

Field of the Invention

The present invention relates to an intermediate transfer member and an image recording method.

Description of the Related Art

A method in which an ink is applied to an intermediate transfer member to form an intermediate image and then this intermediate image is transferred to a recording medium to record an image (also referred to as "an intermediate transfer type image recording method") is known. In recent years, such an intermediate transfer type image recording method that an image of high-level quality is obtained even at a high transfer speed has been studied with the high demand for high-speed recording (Japanese Patent Application Laid-Open No. 2003-182064, Japanese Patent Application Laid-Open No. 2007-268802 and Japanese Patent Application Laid-Open No. 2002-370442).

Japanese Patent Application Laid-Open No. 2003-182064 describes an image recording method using an intermediate transfer member having a rubber layer formed on a substrate composed of a metal drum and an outer layer formed on the rubber layer. A material selected from polyurethane, a fluorinated elastomeric material, fluorinated rubber and silicone rubber is described as a material of the rubber layer. A material selected from sol-gel, ceramers and polyurethane is described as a material of the outer layer.

Japanese Patent Application Laid-Open No. 2007-268802 describes that an amount of a reaction liquid applied per unit area is controlled to an amount of an ink applied per unit area or more, whereby good image quality can be achieved even when the reaction liquid is dried to cause a sink mark.

Japanese Patent Application Laid-Open No. 2002-370442 describes that the surface roughness Ra of the surface of the intermediate transfer member is controlled to 0.2 μm or more and 2.5 μm or less, whereby image quality and transferability can be improved.

SUMMARY OF THE INVENTION

In the above-described image recording method, a liquid forming a high-viscosity intermediate image in contact with a coloring material component in the ink (reaction liquid) is applied on to the intermediate transfer member. However, it is known that the applied state thereof affects the image quality.

In Japanese Patent Application Laid-Open No. 2003-182064, when a low surface energy material such as fluorinated rubber among the materials exemplified as the materials for the intermediate transfer member is used in particular, the reaction liquid is repelled from the surface of the intermediate transfer member, so that the applied state of the reaction liquid does not reach a sufficient level.

Japanese Patent Application Laid-Open No. 2007-268802 describes that silicone rubber is used as a material of the intermediate transfer member, and a liquid having a surface tension of 28.0 mN/m and a low pH is used as the reaction liquid, and the contact angle between the intermediate transfer member and the reaction liquid is 62°. However, as a result of confirmation by the present inventors, it has been known that such constitution fails to cause the applied state of the reaction liquid to reach a sufficient level.

Japanese Patent Application Laid-Open No. 2002-370442 does not specifically describe anything about a technique for stabilizing the applied state of the reaction liquid, which is important for improving the image quality. In addition, there has been a problem that a surface roughness shape for improving the image quality and image transferability are in a trade-off relation.

It is thus an object of the present invention to provide an intermediate transfer member excellent in reaction liquid applicability and intermediate image transferability and an image recording method using such an intermediate transfer member.

The above object can be achieved by the present invention described below. According to the present invention, there is thus provided an intermediate transfer member for use in an image recording method comprising the steps of applying a reaction liquid to the intermediate transfer member, applying an ink to the intermediate transfer member so as to overlap with at least a part of a region to which the reaction liquid has been applied, thereby forming an intermediate image, and transferring the intermediate image to a recording medium, wherein an average of a surface area per unit area of a surface of the intermediate transfer member is 1.2 or more and 10.0 or less.

According to the present invention, there can be provided an intermediate transfer member excellent in reaction liquid applicability and intermediate image transferability and an image recording method using such an intermediate transfer member.

Further features of the present invention will become apparent from the following description of exemplary embodiments with reference to the attached drawings.

DESCRIPTION OF THE EMBODIMENTS

Figure 1:
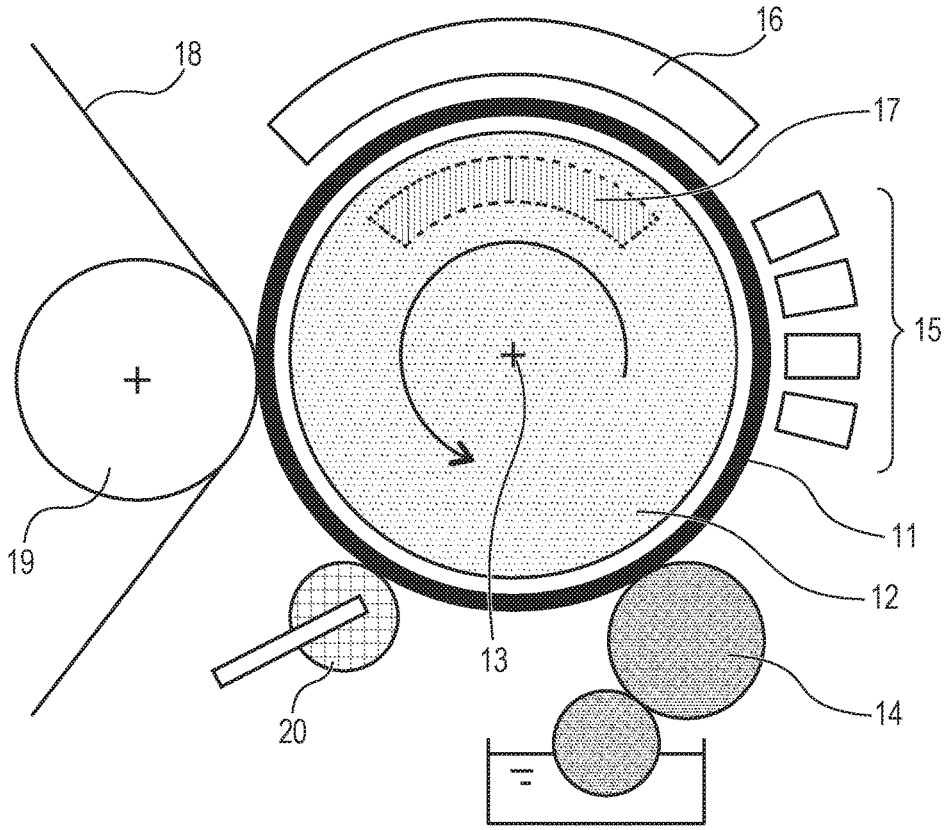
FIG. 1 typically illustrates the construction of an image recording apparatus provided with an intermediate transfer member according to an embodiment of the present invention.

Preferred embodiments of the present invention will now be described in detail in accordance with the accompanying drawings.

An image recording method according to an embodiment of the present invention has a step of applying a reaction liquid to an intermediate transfer member, a step of applying an ink to the intermediate transfer member so as to overlap with at least a part of a region to which the reaction liquid has been applied, thereby forming an intermediate image, and a step of transferring the intermediate image to a recording medium. An average of a surface area per unit area of a surface of the intermediate transfer member is 1.2 or more and 10.0 or less.

The average of the surface area per unit area of the surface of the intermediate transfer member is controlled within the above-described range, whereby the wettability of the surface of the intermediate transfer member with respect to the reaction liquid can be improved. As a result, the reaction liquid is easily evenly spread on a desired region of the surface of the intermediate transfer member. That is, the reaction liquid applicability is improved.

As an example of a method for controlling the average of the surface area per unit area of the surface of the intermediate transfer member to 1.2 or more and 10.0 or less, a method of providing a protruded structure on the surface of the intermediate transfer member is mentioned, which will be described later. It is a conventionally known technique to intentionally provide an uneven shape on the surface of the intermediate transfer member for inhibiting deformation of an intermediate image. However, the mere provision of the uneven shape has caused the lowering of image quality and transferability due to enhancement of surface roughness. However, it has been found that the deformation of the intermediate image can be inhibited without lowering the image quality and intermediate image transferability by providing the protruded structure in such a manner that the average of the surface area per unit area of the surface of the intermediate transfer member is 1.2 or more and 10.0 or less.

An intermediate transfer member according to an embodiment of the present invention and an image recording method will hereinafter be schematically described.

Intermediate Transfer Member (1) Material

The intermediate transfer member becomes a base for holding a reaction liquid and an ink and forming an intermediate image. The intermediate transfer member has a support member for handling the intermediate transfer member and transmitting necessary force and a surface layer member for forming an image. These may be composed of a uniform member or a plurality of independent members.

The surface layer member of the intermediate transfer member may be composed of a single layer or a plurality of layers. The layer structure of the surface layer member may be arbitrarily selected from optimum ones capable of coping with the kind of a recording medium, holdability of an intermediate image on the intermediate transfer member, image transfer rate to the recording medium upon transfer, and quality of the intermediate image. For example, a compression layer may also be provided in the surface layer member of the intermediate transfer member for the purpose of leveling pressure unevenness upon transfer. Here, the "compression layer" is favorably a porous body composed of rubber or an elastomer. In addition, a resin layer, a base fabric layer and/or a metal layer may also be provided in the surface layer member of the intermediate transfer member for the purpose of imparting favorable elastic properties, strength and thermal properties. Further, various kinds of adhesives or double coated tapes may also be present between the surface layer member and the support member for fixing and holding these members.

Examples of the shape of the intermediate transfer member include a sheet-shape, a roller-shape, a drum-shape, a belt-shape and an endless web-shape. Among these shapes, a drum-shaped support member or an intermediate transfer member composed of a belt-shaped endless web is used, whereby the same intermediate transfer member can be continuously and repeatedly used, and so such a shape is extremely favorable from the viewpoint of productivity. The size of the intermediate transfer member may be freely selected according to the size of an intended recording medium.

The support member of the intermediate transfer member is required to have certain structural strength from the viewpoints of conveyance accuracy and durability thereof. Metal, ceramic or resin is favorable as a material of the support member. Among these, aluminum, iron, stainless steel, acetal resin, epoxy resin, polyimide, polyethylene, poly(ethylene terephthalate), nylon, polyurethane, silica ceramic or alumina ceramic is particularly favorably used from the viewpoint of properties required to relieve inertia upon operation to improve the responsiveness of control in addition to stiffness to withstand a pressure upon transfer and dimensional accuracy. Incidentally, these materials may also be used in combination.

The surface layer member of the intermediate transfer member desirably has certain elasticity for bringing the intermediate image into contact under pressure with a recording medium such as paper to transfer the intermediate image to the recording medium. For example, when paper is used as the recording medium, the surface layer member favorably contains a rubber member having a hardness within a range of 10 degrees or more and 100 degrees or less as measured by Durometer Type A (according to JIS K 6253). The surface layer member more favorably contains a rubber member having a hardness of 20 degrees or more and 60 degrees or less.

Various materials such as polymer, ceramic and metal may be suitably used as a material of the surface layer member. However, various rubber materials and elastomeric materials are favorably used from the viewpoints of the above-described properties and processing properties. In particular, when what is called a water-repellent material having moderate low surface energy is used as the surface layer member, its adhesion energy with respect to an reaction aggregate of the reaction liquid and the ink is reduced, and so image transfer efficiency can be improved. As examples of the material of the surface layer member, those containing at least one selected from a fluorine compound and a silicone compound may be mentioned. Specifically, silicone rubber, fluorine-containing rubber and a compound containing a skeletal structure thereof are favorable. In addition, in the surface layer member, a surface layer may be further formed on the layer formed of the above-described material. A compound containing a water-repellent structure typified by a silicone skeleton or perfluoroalkyl skeleton is favorable as a material of the surface layer from the viewpoint of surface energy.

(2) Relation with the Effect of the Invention

The reason why the reaction liquid applicability and intermediate image transferability are improved by the intermediate transfer member according to the present invention will now be described.

(2-1) Improvement in Reaction Liquid Applicability

When a contact angle between a flat solid surface and a liquid droplet is θ, the following Young's formula is generally established among θ, surface tension of a liquid $\gamma_L$, surface tension of a solid $\gamma_S$, and surface tension of a solid-liquid interface $\gamma_{LS}$.

$$\gamma_S=\gamma_{SL}+\gamma_L \cos\theta$$

In addition, the Wenzel model is known as a model indicating the relation between the roughness of a solid surface and wettability. When predetermined roughness is formed on the solid surface, a contact area at a solid-liquid interface increases attending on an uneven surface formed. As a result, an apparent contact angle θ' at the roughened surface is expressed in the following manner, where S1 is a projection surface area in a horizontal direction of the solid, S2 is an actual surface area thereof, and r is S1/S2.

$$\cos\theta'=r\cos\theta=r(\gamma_S-\gamma_{SL})/\gamma_L$$

That is, it is found that θ is larger than θ' (θ'<θ) when θ is larger than 0 and smaller than 90° (0<θ<90°).

In order to stabilize an applied state of the reaction liquid in this embodiment, it would be important to avoid such a state that the reaction liquid is repelled. That is, it is difficult to stably control the area rate of a reaction-liquid-applied portion under such an environment that the reaction-liquid-applied portion and a reaction-liquid-unapplied portion coexist. It is thus considered that the stability of the reaction liquid is more exhibited by applying the reaction liquid to the whole surface of the intermediate transfer member as evenly as possible, i.e., making the area of the reaction-liquid-applied portion as large as possible. In order to widely spread the reaction liquid on the surface of the intermediate transfer member to make the area of the reaction-liquid-applied portion, it is thus better to reduce the apparent contact angle of the reaction liquid on the intermediate transfer member so as to improve the wettability of the reaction liquid against the intermediate transfer member. Specifically, the apparent contact angle is favorably 20° or less, more favorably 10° C. or less.

In order to lower the apparent contact angle on the intermediate transfer member as described above, the relation of $1.2 \leq S2/S1 \leq 10$, where S1 is a projection surface area in a direction perpendicular to the surface of the intermediate transfer member, and S2 is an actual surface area thereof, is favorably satisfied. That is, S2/S1 indicates an average of a surface area per unit area of the surface of the intermediate transfer member, and this average is controlled to 1.2 or more and 10.0 or less. The average S2/S1 is more favorably controlled to 1.4 or more and 5 or less. The apparent contact angle can be thereby more stably lowered to increase the area of the reaction-liquid-applied portion on the surface of the intermediate transfer member. In addition, the projection surface area S1 in the perpendicular direction can be calculated as a surface area when the average surface roughness Ra of the intermediate transfer member is regarded as 0, i.e., a surface area when the surface is flattened, even in the case where the intermediate transfer member is not a sheet shape.

The projection surface area S1 in the perpendicular direction and the actual surface area S2 thereof can be measured from an observation result by, for example, the following method. When the intermediate transfer member is cut into a size of, for example, 1 cm in length and 1 cm in width, the projection surface area S1 in the perpendicular direction can be calculated as a product of the length and the breadth. In addition, the actual surface area S2 can be measured as an adsorption occupancy area by a method of causing known molecules to be adsorbed on the surface to determine the surface area from the amount thereof (for example, the BET method). For example, the intermediate transfer member in this embodiment is cut into a size of 1 cm×1 cm, and the cut piece is air-tightly placed in a sample cell. When nitrogen gas is introduced into it, nitrogen molecules cause multilayer adsorption on the surface of the sample. The monolayer adsorption amount is calculated from information of pressure change at that time. The actual surface area S2 of the intermediate transfer member can be measured from the adsorption area of the nitrogen molecules.

In addition, the actual surface area S2 can also be measured by, for example, a scanning probe microscope (SPM) by which the three-dimensional shape of a sample surface is measured by scanning the sample surface by a fine probe (cantilever). In this case, for example, shape measurement is conducted plural times over a range of 10 μm×10 μm of the intermediate transfer member cut into an arbitrary size by the scanning probe microscope. According to the SPM, height information at respective points of the intermediate transfer member can be obtained every several tens nanometers. The sum total of areas of respective triangles formed by adjoining three points can be measured as the actual surface area S2.

In addition, when a device capable of obtaining three-dimensional measurement information, such as a confocal laser microscope or a scanning optical interferometer, is used, the actual surface area S2 can be measured in the same manner as in SPM.

In order for the surface of the intermediate transfer member to have such numeral range of S2/S1 as described above, the surface of the intermediate transfer member favorably has a plurality of protruded structures. No particular limitation is imposed on the shape in section of the protruded structure. However, the shape is favorably a tetragon (rectangle or square), a triangle, a trapezoid or a combined shape thereof (see FIG. 2).

Figure 2:
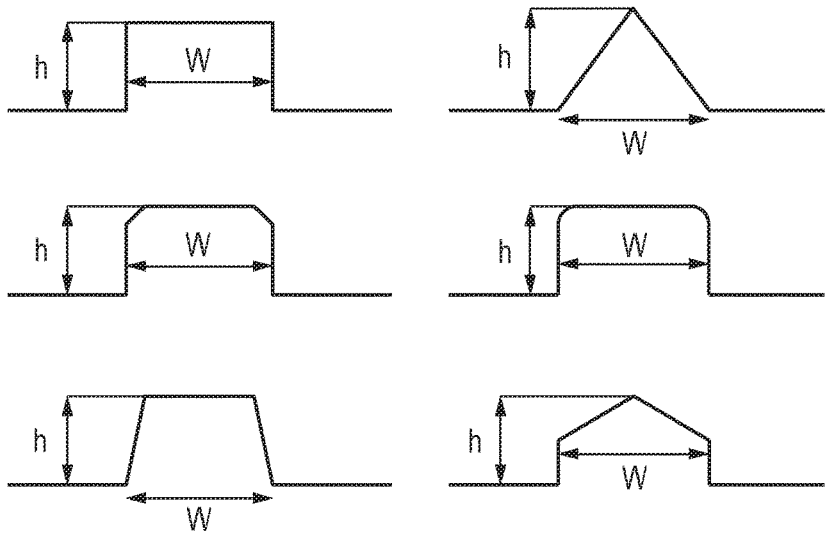
FIG. 2 is a drawing for explaining width and height in a protruded structure.

The average width of the protruded structure (the average of the length of the widest portion when a protruded portion is laterally viewed, i.e. "w" in each protruded structure in FIG. 2) is favorably 10 μm or less. The average width of the protruded structure is 10 μm or less, whereby the actual surface area S2 can be made large to make the apparent contact angle effectively small, so that the effect of the present invention can be effectively developed. The average width is more favorably 1 μm or less. Further, the average width of the protruded structure is favorably controlled to the average diameter of an ink droplet or less. Incidentally, when an ink for use in an ink jet recording method is applied to the intermediate transfer member, the average diameter of the ink droplet is generally 10 μm or more and 100 μm or less.

The average height of the protruded structure (the average of the length from a bottom of a protruded portion to a portion most distant from the bottom when the protruded portion is laterally viewed, i.e. "h" in each protruded structure in FIG. 2) is favorably 0.05 μm or more and 1.00 μm or less. When the average height of the protruded structure is less than 0.05 μm, the effect to lower the apparent contact angle become small, and so the stability of the applied state of the reaction liquid is lowered. When the average height of the protruded structure exceeds 1.00 μm, the image quality and transferability of the intermediate image may be lowered in some cases. Further, the average height of the protruded structure is more favorably 0.1 μm or more and 0.5 μm or less.

The average width and average height of the protruded structure are values derived by respectively measuring widths and heights of 30 protruded structures arbitrarily selected and calculating averages thereof.

When the average diameter of an ink droplet applied on to the surface of the intermediate transfer member is R μm, the protruded structures are favorably formed in such a manner that the proportion of the area of portions where the protruded structures are present in a region of R μm×R μm in an ink-applicable portion on the surface of the intermediate transfer member is 90% or more. The protruded structures are arranged in such a proportion on the intermediate transfer member, whereby an evener reaction liquid layer can be brought into contact with most of the ink to impact on the intermediate transfer member to improve the image quality of the intermediate image.

The above-described proportion can be measured by an observation method by means of a scanning probe microscope, a confocal laser microscope or a scanning optical interferometer. In addition, the proportion can also be identified by extracting arbitrary N regions of R μm×R μm on the surface of the intermediate transfer member and observing the presence of the protruded structures in 0.9N regions or more among them.

The Wenzel model indicating the relation between the surface roughness and wettability is a model assuming that no air enters between the protruded structures, and the reaction liquid and the ink come into ideal contact with each other on the surfaces of the protruded structures. In reality, air enters between the protruded structures, whereby the contact between the reaction liquid and the ink may be adversely affected in some cases. In order to realize the stably applied state of the reaction liquid so as to improve its contactability with the ink, it is thus necessary to remove its interface with air as much as possible so as to prevent the reaction liquid from being unstably applied. Therefore, it is necessary to push out air having entered between the protruded structures so as to fill a space between the protruded structures with the reaction liquid. When a process speed is accelerated in particular, it may be difficult in some cases to fill the space between the protruded structures with the reaction liquid. This is likely to occur when the flowability of the reaction liquid is small and is a phenomenon appearing in the case where the process speed is higher than the speed of the reaction liquid in its moving direction between the protruded structures. In addition, the reaction liquid may also be applied in such a state that the reaction liquid is pressurized by a roller or squeegee so as to push out the air between the protruded structures for the purpose of effectively developing the above-described effect.

The protruded structure can be formed by preparing a pattern having a desired shape and transferring the shape to the surface of the intermediate transfer member. In order to form a fine pattern as the protruded structure in particular, for example, a conventionally known nanoimprint method may be used. This method is a method of bringing a mold in which a minute pattern shape has been formed by a microfabrication method such as photolithography into contact under pressure with a substrate composed of a polymer or glass to transfer a desired shape to the substrate. Besides, a microfabrication method such as electron beam lithography may be optionally used.

In addition, anodized porous alumina obtained by anodizing an aluminum material in an acidic liquid has such a structure that columnar pores are regularly arranged. This porous alumina or a negative structure formed by using it as a mold can also be used to transfer such a shape to the surface of the intermediate transfer member.

(2-2) Improvement in Transfer Efficiency of Intermediate Image

As described in item (2-1), the reaction liquid applicability is improved, whereby regions to which the reaction liquid is not applied is reduced in the intermediate transfer member. Therefore, when the ink is further applied, the ink which cannot react with the reaction liquid but comes into direct contact with the intermediate transfer member is extremely reduced. As a result, the contact area between the intermediate image and the intermediate transfer member becomes small, so that the intermediate image is easily separated from the intermediate transfer member upon transfer to move to the recording medium, whereby the intermediate image transferability can be improved.

In addition, the intermediate transfer member has the protruded structure, whereby the intermediate image transferability can be more effectively improved. This is considered to be attributable to the result that the contact area between the intermediate image and the intermediate transfer member becomes smaller.

Reaction Liquid

The reaction liquid contains a component (hereinafter may referred to as "an ink viscosity-increasing component") increasing the viscosity of an ink. Here, the ink viscosity increase means the case where a coloring material and a resin which constitute the ink come into contact with the ink viscosity-increasing component, thereby being chemically reacted or physically adsorbed to observe viscosity increase of the overall ink. The case where a local viscosity increase by aggregation of a part of an ink composition, such as a coloring material, is caused is also included, not limited to the above case. Incidentally, "reaction" in "the reaction liquid" includes not only the case where a chemical reaction is caused with the ink, but also the case where a physical action (for example, adsorption) is caused. The ink viscosity-increasing component has an effect to lower the flowability of an ink and/or a part of an ink composition on the intermediate transfer member, thereby inhibiting bleeding and beading upon the formation of an image.

Conventionally known materials such as polyvalent metal ions, organic acids, cationic polymers and porous fine particles may be used as the ink viscosity-increasing component without particular limitation. Among these, polyvalent metal ions and organic acids are particularly favorable. In addition, it is effective to contain a plurality of ink viscosity-increasing components. Incidentally, the content of the ink viscosity-increasing component in the reaction liquid is favorably 5% by mass or more based on the total mass of the reaction liquid.

Specific examples of a metal ion usable as the ink viscosity-increasing component include divalent metal ions such as $Ca^{2+}$, $Cu^{2+}$, $Ni^{2+}$, $Mg^{2+}$, $Sr^{2+}$, $Ba^{2+}$ and $Zn^{2+}$, and trivalent metal ions such as $Fe^{3+}$, $Cr^{3+}$, $Y^{3+}$ and $Al^{3+}$.

Specific examples of an organic acid usable as the ink viscosity-increasing component include oxalic acid, polyacrylic acid, formic acid, acetic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumalic acid, thiophenecarboxylic acid, nicotinic acid, oxysuccinic acid and dioxysuccinic acid.

The reaction liquid may contain a proper amount of water and/or an organic solvent. Water used in this case is favorably water deionized by, for example, ion exchange. No particular limitation is imposed on the organic solvent used in the reaction liquid, and any of publicly known organic solvents may be used.

Various resins may also be added to the reaction liquid. For example, a proper resin is added to the reaction liquid, whereby it is possible to obtain a good adhesion property of the intermediate image to the recording medium upon transfer and improve the mechanical strength of a final image. It is thus favorable to add such a resin. No particular limitation is imposed on a materials used in this resin so far as it can coexist with the ink viscosity-increasing component.

In addition, a surfactant and/or a viscosity modifier may be added to the reaction liquid to suitably adjust the surface tension and viscosity of the reaction liquid before use. No particular limitation is imposed on the materials used at this time so far as they can coexist with the ink viscosity-increasing component. Specific examples of the surfactant used include Acetylenol E100 (product of Kawaken Fine Chemicals Co., Ltd.). The surface energy of the reaction liquid is controlled to favorably 50 mN/m or more, more favorably 20 mN/m or more and 40 mN/m or less.

Application of Reaction Liquid

As a method for applying the reaction liquid to the surface of the intermediate transfer member, various methods heretofore known may be suitably used. Specific examples thereof include die coating, blade coating, a method using a gravure roller, a method using an offset roller and spray coating. In addition, an application method using an ink jet device is also favorable. Further, it is extremely favorable to use some methods thereof in combination. The reaction liquid is favorably applied to the whole surface of the intermediate transfer member.

Formation of Intermediate Image

The ink is applied to the surface of the intermediate transfer member to which the reaction liquid has been applied, thereby forming an intermediate image. Incidentally, the "intermediate image" means an image formed on the intermediate transfer member before transferred to a recording medium.

For example, an ink jet device may be used for application of the ink. As examples of mode of the ink jet device, the following modes may be mentioned:

A mode of causing film boiling in an ink by an electrothermal converter to form a bubble, thereby ejecting the ink;

A mode of ejecting an ink by an electromechanical converter; and

A mode of ejecting an ink by means of static electricity.

Any of the various ink jet devices proposed in ink jet liquid ejection technologies as described above may be used. Among these, the mode of utilizing the electrothermal converter is favorably used from the viewpoint of high-speed and high-density printing in particular.

No particular limitation is imposed on the mode of the whole ink jet device. For example, the following ink jet heads may be used.

An ink jet head of what is called a shuttle form with which recording is conducted while scanning the head perpendicularly to a moving direction of the intermediate transfer member; and An ink jet head of what is called a line head form in which ink ejection orifices are arranged in a line substantially perpendicularly (in the case where the intermediate transfer member is a drum shape, substantially in parallel to an axial direction) to a moving direction of the intermediate transfer member.

Ink

Respective components usable in the ink will hereinafter be described.

(1) Coloring Material

In the ink, a coloring material with a publicly known dye, carbon black or an organic pigment dissolved and/or dispersed therein may be used. Among these, various pigments may be favorably used from the viewpoints of durability and quality of the resulting print.

(2) Pigment

No particular limitation is imposed on the pigment, and any publicly known inorganic pigment or organic pigment may be used. Specifically, pigments indicated by COLOR INDEX (C.I.) numbers may be used. In addition, carbon black is favorably used as a black pigment. the content of the pigment in the ink is favorably 0.5% by mass or more and 15.0% by mass or less, more favorably 1.0% by mass or more and 10.0% by mass or less based on the total mass of the ink.

(3) Pigment Dispersant

Any dispersant may be used as a dispersant for dispersing the pigment so far as it is conventionally known and used in ink jet. Among others, a water-soluble dispersant having a hydrophilic portion and a hydrophobic portion in combination in a molecular structure thereof is favorably used. A pigment dispersant composed of a resin obtained by copolymerizing at least a hydrophilic monomer and a hydrophobic monomer is particularly favorably used. Here, no particular limitation is imposed on the respective monomers used, and publicly known monomers are favorably used. Specific example of the hydrophobic monomer include styrene, styrene derivatives, alkyl (meth)acrylates and benzyl (meth)acrylates. Specific examples of the hydrophilic monomer include acrylic acid, methacrylic acid and maleic acid. The acid value of the dispersant is favorably 50 mg KOH/g or more and 550 mg KOH/g or less. In addition, the weight-average molecular weight of the dispersant is favorably 1,000 or more and 50,000 or less. Incidentally, the mass ratio of the pigment to the dispersant in the ink is favorably within a range of from 1:0.1 to 1:3

In addition, what is called a self-dispersible pigment obtained by modifying the surface of a pigment itself so as to permit it to be dispersed without using a dispersant is favorably used as another mode of the ink.

(4) Resin Fine Particle

The ink may contain various fine particles having no coloring material. Among these, a resin fine particle is favorable because it may have an effect to improve image quality and fixability in some cases. No particular limitation is imposed on a material of the resin fine particle, and a publicly known resin may be used. Specific examples thereof include homopolymers such as polyolefin, polystyrene, polyurethane, polyester, polyether, polyurea, polyamide, polyvinyl alcohol, poly(meth)acrylic acid and salt thereof, poly(alkyl (meth)acrylate), and polydiene, and copolymers obtained by combining a plurality of these monomers. The mass-average molecular weight of the resin is favorably within a range of 1,000 or more and 2,000,000 or less. The content of the resin fine particle in the ink is favorably 1% by mass or more and 50% by mass or less, more favorably 2% by mass or more and 40% by mass or less based on the total mass of the ink.

In addition, the resin fine particle is favorably used as a resin fine particle dispersion dispersed in the ink. No particular limitation is imposed on a dispersion method. However, what is called a self-dispersion type resin fine particle dispersion obtained by dispersion using a resin obtained by homo-polymerizing a monomer having a dissociating group or copolymerizing plural kinds of such monomers is favorable. Examples of the dissociating group include a carboxyl group, a sulfonic group and phosphoric group. Examples of the monomer having this dissociating group include acrylic acid and methacrylic acid. In addition, what is called an emulsion-dispersion type resin fine particle dispersion obtained by dispersing the resin fine particle with an emulsifier may also be favorably used likewise. As the emulsifier used herein, a publicly known surfactant is favorably used irrespective of its molecular weight. The surfactant is favorably a nonionic surfactant or a surfactant having the same charge as the resin fine particle. The resin fine particle has a dispersion particle diameter of desirably 10 nm or more and 1,000 nm or less, more desirably 100 nm or more and 500 nm or less.

In addition, it is also favorable to add various kinds of additives upon the preparation of the resin fine particle dispersion for stabilizing the dispersion. Favorable examples of these additives include n-hexadecane, dodecyl methacrylate, stearyl methacrylate, chlorobenzene, dodecylmercaptan, olive oil, a blue dye (Blue 70) and polymethyl methacrylate.

(5) Surfactant

The ink may contain a surfactant. Specific examples of the surfactant include Acetylenol EH (product of Kawaken Fine Chemicals Co., Ltd.). The content of the surfactant in the ink is favorably 0.01% by mass or more and 5.0% by mass or less based on the total mass of the ink.

(6) Water and Water-Soluble Organic Solvent

The ink may contain water and/or a water-soluble organic solvent as a solvent. Water is favorably water deionized by, for example, ion exchange. The content of water in the ink is favorably 30% by mass or more and 97% by mass or less based on the total mass of the ink. No particular limitation is imposed on the kind of the water-soluble organic solvent used in the ink, and any of publicly known organic solvents may be used. Specific examples thereof include glycerol, diethylene glycol, polyethylene glycol and 2-pyrrolidone. The content of the water-soluble organic solvent in the ink is favorably 3% by mass or more and 70% by mass or less based on the total mass of the ink.

(7) Other Additives

The ink may contain various additives such as a pH adjustor, a rust preventive, a preservative, a mildewproofing agent, an antioxidant, an anti-reducing agent, a water-soluble resin and a neutralizer thereof, and a viscosity modifier, as needed, in addition to the above-described components.

Transfer of Intermediate Image

After the intermediate image is formed, the intermediate transfer member is brought into contact under pressure with a recording medium to transfer the intermediate image to the recording medium, thereby obtaining a final image. In the present specification, the "recording medium" means not only paper used in general printing, but also a wide variety of printing media and recording media such as fabrics, plastics and films.

No particular limitation is imposed on a method for bringing the intermediate transfer member into contact under pressure with the recording medium. However, it is favorable to pressurize the intermediate transfer member and the recording medium from both sides thereof by means of pressure rollers because the image is efficiently transferred and formed. In addition, multi-stage pressurization is also favorable because it may be effective for reduction in transfer failure in some cases.

Water Removal

It is also favorable to provide a step of reducing liquid components from the intermediate image formed on the intermediate transfer member. If the liquid components of the intermediate image are excessive, excess liquid is protrudes or overflows in the transfer step, which may form the cause of image disorder or transfer failure. As a method for removing the liquid component from the intermediate image, any conventionally used method may be suitably used. For example, any of a method by heating, a method of blowing low-humidity air, a method of reducing a pressure and a method of combining these methods is suitably used. In addition, air drying may also be used.

Cleaning

It is favorable to provide a step of cleaning the intermediate transfer member because the intermediate transfer member can be used repeatedly and continuously. As a method for cleaning the intermediate transfer member, the following methods are mentioned:

A method of applying a cleaning liquid in a showered state on to the surface of the intermediate transfer member;

A method of bringing a wetted molleton roller into contact with the surface of intermediate transfer member to wipe off;

A method of bring the surface of intermediate transfer member into contact with the surface of a cleaning liquid;

A method of wiping off the surface of the intermediate transfer member by a wiper blade; and A method of applying various kinds of energies to the surface of the intermediate transfer member.

In addition, a method of combining plural methods among these methods is also favorable.

Fixing

After the transfer, the recording medium, on which the image has been recorded, may also be pressed by a roller to improve fixability between the recording medium and the image. In addition, the fixability may be improved in some cases by heating the recording medium, and so the heating of the recording medium is also favorable. Needless to say, a heated roller may also be used to conduct these methods at the same time.

The present invention will hereinafter be described more specifically by Examples of an intermediate transfer member and an image recording method and Comparative Examples. Incidentally, the present invention is not limited by the following Examples unless going beyond the gist thereof. In addition, "parts" or "part" shown below means "parts by mass" or "part by mass", and "%" means "% by mass.

Image Recording Apparatus

FIG. 1 typically illustrates an image recording apparatus used in the following Examples and Comparative Examples. This image recording apparatus has an intermediate transfer member rotatable on a rotation axis 13. The intermediate transfer member has a drum-shaped support member 12 and a surface layer member 11 provide on an outer peripheral surface of the support member 12. The intermediate transfer member is rotationally driven in a direction of an arrow on the rotation axis 13, and respective devices arranged on the periphery of the intermediate transfer member are actuated in synchronism with the rotation thereof.

In the apparatus illustrated in FIG. 1, a cylindrical drum formed of an aluminum alloy was used as the support member 12 of the intermediate transfer member. Required properties of relieving rotational inertia to improve responsiveness of control can be thereby satisfied in addition to stiffness for withstanding a pressure upon transfer and dimensional accuracy. A member obtained by molding a silicone rubber (KE12, product of Shin-Etsu Chemical Co., Ltd.) having a hardness of 40° as measured by Durometer Type A (according to JIS K 6253) into a thickness of 0.3 mm was used as the surface layer member 12. Alternatively, a member obtained by molding a fluorine-containing rubber (SIFEL 3450, product of Shin-Etsu Chemical Co., Ltd.) into a thickness of 0.3 mm was used.

In respective Examples, protruded structures having their corresponding sizes shown in Table 1 were formed on the surface layer member 11. Incidentally, "S2/S1" in Table 1 is an index where S1 is the projection surface area in a direction perpendicular to the surface of the intermediate transfer member, and S2 is the actual surface area thereof. The surface areas, and heights and widths of the protruded structures were measured by suitably using a scanning probe microscope (SPM, manufactured by SII Nano Technology Inc.), a scanning electron microscope (SEM, manufactured by Hitachi High-Technologies Corporation) and a laser microscope (OLS, manufactured by OLYMPUS CORPORATION). The protruded structure was formed by preparing an anodized porous alumina by setting arbitrary conditions or formed using a photolithographic method on a silicone wafer, and then a shape thereof is transferred to the intermediate transfer member.

In respective Comparative Examples, silicone rubber or fluorine-containing rubber having a flat surface without forming the protruded structure was used as the surface layer member 11. The surface roughness Ra thereof was 0.001 μm in terms of arithmetic mean roughness. The sizes of the intermediate transfer members used in respective Comparative Examples are shown in Table 1.

TABLE 1

| | Material of intermediate transfer member | S2/S1 [—] | Average height [μm] | Average width [μm] | Ink droplet diameter [μm] |
|---|---|---|---|---|---|
| Ex. 1 | Silicone rubber | 10.0 | 1.0 | 0.2 | 50 |
| Ex. 2 | Silicone rubber | 5.0 | 0.8 | 0.2 | 30 |
| Ex. 3 | Silicone rubber | 2.5 | 0.5 | 0.8 | 20 |
| Ex. 4 | Silicone rubber | 1.8 | 0.5 | 1.0 | 25 |
| Ex. 5 | Silicone rubber | 1.6 | 0.3 | 0.4 | 25 |
| Ex. 6 | Silicone rubber | 1.4 | 0.3 | 1.0 | 25 |
| Ex. 7 | Silicone rubber | 1.2 | 1.0 | 6.0 | 20 |
| Ex. 8 | Silicone rubber | 1.2 | 0.1 | 0.9 | 20 |
| Ex. 9 | Fluorine-containing rubber | 10.0 | 0.9 | 0.1 | 25 |
| Ex. 10 | Fluorine-containing rubber | 1.5 | 0.3 | 0.4 | 25 |
| Ex. 11 | Fluorine-containing rubber | 1.2 | 1.0 | 10.0 | 10 |
| Comp. Ex. 1 | Silicone rubber | 1.1 | 0.1 | 5.0 | 30 |
| Comp. Ex. 2 | Silicone rubber | 12.0 | 3.0 | 0.5 | 30 |

The intermediate transfer member comes into contact with a coating roller constituting a roller type coating. A reaction liquid can be continuously applied to the surface of the intermediate transfer member by this roller type coating device 14. An ink jet device is provided so as to oppose the surface of the intermediate transfer member, whereby an ink can be applied to the surface of the intermediate transfer member. A blower 16 is arranged so as to oppose the surface of the intermediate transfer member for the purpose of reducing liquid components in the ink forming an intermediate image on the surface of the intermediate transfer member. In addition, a heater 17 provided within the support member 12 so as to be able to heat the intermediate image from a back side of the intermediate transfer member. The liquid components in the intermediate image can be dried by the blower 16 and the heater 17 to inhibit disorder of the intermediate image upon transfer.

In addition, a pressure roller 19 is arranged so as to come into contact with the intermediate transfer member through a recording medium 18. The intermediate image formed on the intermediate transfer member is brought into contact with the recording medium 18 by this pressure roller 19, thereby transferring the intermediate image to the recording medium 18 to form an image. In the apparatus illustrated in FIG. 1, the intermediate image and the recording medium 18 are pressurized so as to be sandwiched between the support member 12 and the pressure roller 19, thereby efficiently realize the transfer of the intermediate image.

In the above-described Examples and Comparative Examples, a PET film (thickness: 150 W whose surface had been subjected to a hydrophilizing treatment was used as the recording medium 18. Before the transfer of the intermediate image, the ink reacts with the reaction liquid on the surface of the intermediate transfer member to increase the viscosity thereof and reduce the liquid component. Therefore, the image can be transferred to the recording medium even when the recording medium 18 has little ink absorbency, such as the PET film, is used. In addition, a continuous rolled sheet was used as the shape of the recording medium 18. However, a sheet cut into a specified size may also be used.

In addition, a molleton roller constituting a cleaning unit 20 is arranged so as to come into intermittent contact with the intermediate transfer member. The molleton roller is always wetted with ion-exchanged water. The intermediate transfer member after the intermediate image is transferred to the recording medium is cleaned by this cleaning unit 20 to be repeatedly used in the next intermediate image formation.

Preparation of Reaction Liquid

The reaction liquid was prepared by mixing components of the following composition, sufficiently stirring the resultant mixture and then filtering the mixture under pressure through a microfilter (product of Fuji Photo Film Co., Ltd.) having a pore size of 3.0 μm.

| | |
|---|---|
| Glutaric acid | 55 parts |
| 8N aqueous potassium hydroxide solution | 20 parts |
| Glycerol | 10 parts |
| Surfactant (Acetylenol E100) | 1 part |
| Ion-exchanged water | 14 parts. |

Preparation of Ink

Preparation of Ink

Respective pigment dispersion liquids and a resin fine particle dispersion were first prepared according to the following respective procedures.

(1) Preparation of Black Pigment Dispersion Liquid

Ten parts of carbon black (trade name: Monarch 1100, product of Cabot Co.), 15 parts of an aqueous solution of a pigment dispersant [styrene-ethyl acrylate-acrylic acid terpolymer (acid value: 150, weight-average molecular weight: 8,000); solid content: 20%; neutralized with potassium hydroxide] and 75 parts of pure water were mixed. A batch type vertical sand mill (manufactured by AIMEX Co.) was charged with this mixture and 200 parts of zirconia beads having a diameter of 0.3 mm to conduct a dispersing treatment for 5 hours while cooling with water. The thus-obtained dispersion liquid was centrifuged by a centrifugal separator to remove coarse particles, thereby obtaining a black pigment dispersion liquid having a pigment concentration of about 10%.

(2) Preparation of Cyan Pigment Dispersion Liquid

A cyan pigment dispersion liquid was prepared in the same manner as in the preparation of the black pigment dispersion liquid except that 10 parts of carbon black used upon the preparation of the black pigment dispersion liquid was changed to 10 parts of C.I. Pigment Blue 15:3.

(3) Preparation of Magenta Pigment Dispersion Liquid

A magenta pigment dispersion liquid was prepared in the same manner as in the preparation of the black pigment dispersion liquid except that 10 parts of carbon black used upon the preparation of the black pigment dispersion liquid was changed to 10 parts of C.I. Red 122.

(4) Preparation of Yellow Pigment Dispersion Liquid

A yellow pigment dispersion liquid was prepared in the same manner as in the preparation of the black pigment dispersion liquid except that 10 parts of carbon black used upon the preparation of the black pigment dispersion liquid was changed to 10 parts of C.I. Pigment Yellow 74.

(5) Preparation of Resin Fine Particle Dispersion

Eighteen parts of butyl methacrylate, 2 parts of 2,2'-azobis-(2-methylbutyronitrile) and 2 parts of n-hexadecane were mixed and stirred for 0.5 hours. This mixture was added dropwise to 78 parts of a 6% aqueous solution of a styrene-acrylic acid copolymer (acid value: 120 mg KOH/g, weight-average molecular weight: 8,700), which is an emulsifier, and the resultant mixture was stirred for 0.5 hours. The mixture was then irradiated with ultrasonic waves for 3 hours by an ultrasonic wave irradiation machine. A polymerization reaction was then conducted for 4 hours at 80° C. under a nitrogen atmosphere, and the reaction product was filtered after cooling at room temperature to obtain a resin fine particle dispersion having a concentration of about 20%. The mass-average molecular weight of the resin fine particle was about 200,000, and the dispersion particle diameter thereof was about 250 nm.

Black, cyan, magenta and yellow inks were respectively prepared according to the following composition. Specifically, the inks were prepared by mixing the following respective components, sufficiently stirring the resultant mixtures and then filtering the mixtures under pressure through a microfilter (product of Fuji Photo Film Co., Ltd.) having a pore size of 3.0 μm.

| | |
|---|---|
| Each color pigment dispersion liquid (concentration: about 10%) | 20 parts |
| Resin fine particle dispersion (concentration: about 20%) | 20 parts |
| Glycerol | 5 parts |
| Diethylene glycol | 5 parts |
| Surfactant (Acetylenol E100) | 1 part |
| Ion-exchanged water | 45 parts. |

Image Recording Method

When an image is formed by means of the apparatus illustrated in FIG. 1, the reaction liquid is first applied to the surface of the intermediate transfer member by the roller type coating device 14 while rotating the intermediate transfer member in a direction of the arrow. The ink is then ejected on the surface of the intermediate transfer member from the ink jet device 15. The reaction liquid thereby reacts with the ink on the surface of the intermediate transfer member to form an intermediate image. After the intermediate image is formed, water in the intermediate image is removed by the heater 17 provided within the support member 12 of the intermediate transfer member and the blower 16. The intermediate image passes through between the intermediate transfer member and the pressure roller 19 with the rotation of the intermediate transfer member. At this time, the intermediate image is brought into contact under pressure with the recording medium 18, whereby the intermediate image is transferred to the recording medium 18 from the intermediate transfer member. The surface of the intermediate transfer member after the transfer of the intermediate image is cleaned by the cleaning unit 20 to clean it. The above-described process is repeated with the rotation of the intermediate transfer member, thereby conducting image recording repeatedly.

Image recording of Examples 1 to 11 and Comparative Examples 1 and 2 was conducted according to the above-described image recording method using the image recording apparatus illustrated in FIG. 1. With respect to the resultant images, reaction liquid applicability and transferability were evaluated in the following manner. Incidentally, a coverage regarding the reaction liquid applicability indicates a covered proportion of a reaction liquid layer with respect to the surface of the intermediate transfer member, and the transferability was evaluated by a transfer rate to the recording medium.

An arbitrary region of the surface of the intermediate transfer member to which the reaction liquid has been applied is observed through a light microscope to measure the value (area where the reaction liquid is present)/(surface area of the intermediate transfer member), whereby a coverage of the reaction liquid layer with respect to the surface of the intermediate transfer member can be calculated.

The intermediate transfer member after the transfer step is observed through a light microscope to calculate a remaining area of the intermediate image, whereby a transfer rate to the recording medium can be measured by calculating the value [100−(remaining area of the intermediate image)/(area of the intermediate image)].

Evaluation Criteria of Reaction Liquid Applicability

AA: The coverage of the reaction liquid layer to the surface of the intermediate transfer member is 90% or more;

A: The coverage of the reaction liquid layer to the surface of the intermediate transfer member is 80% or more and less than 90%;

B: The coverage of the reaction liquid layer to the surface of the intermediate transfer member is 70% or more and less than 80%;

C: The coverage of the reaction liquid layer to the surface of the intermediate transfer member is less than 70%.

Evaluation Criteria of Transferability

AA: The transferability to the recording medium is 95% or more;

A: The transferability to the recording medium is 90% or more and less than 95%;

B: The transferability to the recording medium is 60% or more and less than 90%;

C: The transferability to the recording medium is less than 60%.

Evaluation results are shown in Table 2.

TABLE 2

| | Reaction liquid applicability | Transferability |
|---|---|---|
| Ex. 1 | AA | A |
| Ex. 2 | AA | A |
| Ex. 3 | AA | AA |
| Ex. 4 | AA | AA |
| Ex. 5 | AA | AA |
| Ex. 6 | AA | AA |
| Ex. 7 | A | A |
| Ex. 8 | A | AA |
| Ex. 9 | AA | A |
| Ex. 10 | AA | AA |
| Ex. 11 | A | A |
| Comp. Ex. 1 | C | A |
| Comp. Ex. 2 | AA | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An intermediate transfer member for use in an image recording method comprising the steps of applying a reaction liquid to the intermediate transfer member, applying an ink to the intermediate transfer member so as to overlap with at least a part of a region to which the reaction liquid has been applied, thereby forming an intermediate image, and transferring the intermediate image to a recording medium, the intermediate transfer member comprising a surface having a plurality of protruded structures, wherein the surface of the intermediate transfer member is such that $1.2 \leq S2/S1 \leq 10$, where S1 is a projection surface area in a direction perpendicular to the surface of the intermediate transfer member, S2 is an actual surface area of the intermediate transfer member, and S2/S1 is an average of a surface area per unit area of the surface of the intermediate transfer member.

2. The intermediate transfer member according to claim 1, wherein when an average diameter of an ink droplet applied to the intermediate transfer member in the step of forming the intermediate image is regarded as R μm, a proportion of an area of portions where the protruded structures are present in a region of R μm×R μm in an ink-applicable portion on the surface of the intermediate transfer member is 90% or more.

3. The intermediate transfer member according to claim 1, wherein the surface of the intermediate transfer member contains at least one selected from a fluorine compound and a silicone compound.

4. The intermediate transfer member according to claim 1, wherein the surface of the intermediate transfer member is such that $1.4 \leq S2/S1 \leq 5$.

5. The intermediate transfer member according to claim 1, wherein the surface of the intermediate transfer member is such that $1.4 \leq S2/S1 \leq 2.5$.

6. The intermediate transfer member according to claim 1, wherein a shape of the intermediate transfer member is selected from a sheet shape, a roller shape, a drum shape, a belt shape, and an endless web shape.

7. The intermediate transfer member according to claim 1, which has a drum-shaped support member and a surface layer member provided on an outer peripheral surface of the drum-shaped support member.

8. The intermediate transfer member according to claim 1, wherein a shape in a section of a protruded structure of the plurality of protruded structures is a tetragon, a triangle, a trapezoid, or a combination thereof.

9. The intermediate transfer member according to claim 1, which has a surface layer member hardness of 10 degrees to 100 degrees.

10. The intermediate transfer member according to claim 1, which has a surface layer member hardness of 20 degrees to 60 degrees.

11. An image recording method comprising:

applying a reaction liquid to an intermediate transfer member;

applying an ink to the intermediate transfer member so as to overlap with at least a part of a region to which the reaction liquid has been applied, thereby forming an intermediate image; and transferring the intermediate image to a recording medium, wherein the intermediate transfer member is the intermediate transfer member according to claim 1.

12. The image recording method according to claim 11, wherein the reaction liquid contains a component increasing a viscosity of the ink.

13. The intermediate transfer member according to claim 1, wherein the surface of the intermediate transfer member has an apparent contact angle of 20° or less.

* * * * *